US006094759A

United States Patent [19]

Thompson

[11] Patent Number: 6,094,759

[45] Date of Patent: Aug. 1, 2000

[54] ELONGATED CONVERTIBLE BLANKET

[75] Inventor: Thomas L. Thompson, Balboa, Calif.

[73] Assignee: Sleepmakers Incorporated, Balboa, Calif.

[21] Appl. No.: 09/431,563

[22] Filed: Oct. 29, 1999

[51] Int. Cl.[7] ..... A47G 9/02

[52] U.S. Cl. ..... 5/420; 5/502

[58] Field of Search ..... 5/417, 420, 419, 5/418, 500, 502, 482, 495; 2/69, 69.5

[56] References Cited

U.S. PATENT DOCUMENTS

| | | | |
|---|---|---|---|
| 1,237,243 | 8/1917 | Conner . | |
| 1,871,003 | 8/1932 | Longlpüz et al. | 5/502 |
| 2,038,335 | 4/1936 | Aronow | 5/419 |
| 2,183,418 | 12/1939 | Williams | 2/69.5 |
| 2,344,010 | 3/1944 | Walsh | 5/417 |
| 2,788,533 | 4/1957 | Bornstein | 5/420 |
| 3,222,695 | 12/1965 | Brown . | |
| 3,477,552 | 11/1969 | Goldman | 5/420 |
| 3,774,249 | 11/1973 | Ybarra et al. | 5/419 |
| 3,879,775 | 4/1975 | Iwath | 5/420 |
| 3,902,753 | 9/1975 | Wilson . | |
| 4,375,111 | 3/1983 | Hall | 5/419 |
| 4,989,285 | 2/1991 | Troncone et al. | 5/502 |
| 5,010,610 | 4/1991 | Ackley | 5/502 |
| 5,035,013 | 7/1991 | Bloom | 5/420 |
| 5,179,741 | 1/1993 | Book | 5/417 |
| 5,414,881 | 5/1995 | Terrazas | 5/417 |
| 5,481,768 | 1/1996 | Shink | 5/420 |

FOREIGN PATENT DOCUMENTS

| | | |
|---|---|---|
| 484456 | 5/1938 | United Kingdom . |

*Primary Examiner*—Alexander Grosz
*Attorney, Agent, or Firm*—James G. O'Neill

[57] ABSTRACT

An improved blanket is formed from two pieces of 100% polyester fleece material. The two pieces of polyester fleece material are secured together by an outer overlock stitched edge and loosely sewn-in fold lines, so as to be easily folded into predetermined shapes, having approximately equal dimensions. The secured-together pieces of 100% polyester fleece material include soft velour outer surfaces, which are always on the exterior of the blanket whether it is folded or rolled.

7 Claims, 1 Drawing Sheet

23
20
26
34
18
16
24
28
32
17
19
14
30
22
21
5
5
10

10

16
26
36
19
28
14
17

10

38
34
19
30
32
17
19

10
19
30
32
34

12
14
12

ELONGATED CONVERTIBLE BLANKET

BACKGROUND OF THE INVENTION

1. Field of the Invention

This invention relates generally to blankets, and, more particularly, to an improved elongated blanket made from two layers of material, sewn together to form fold lines to enable the blanket to be easily folded into various useful articles.

2. Description of Related Art

Most blankets and/or pillows made, sold and used throughout the world are not useful for all persons. For example, pillows include particle fill material, such as feathers, down, synthetic filament yarn, buckwheat hulls, cherry pits, etc. While blankets may be made from any number of artificial or natural materials. Both feathers and sown fill material in pillows can induce intense head sweats in sleepers and many blankets and pillows harbor known allergens, such as dust mites, etc., which can cause allergic symptoms in an estimated 20% of Americans, or roughly 58 million people.

The blanket industry uses standard dimensions for its blankets, depending on the size of the bed on which the blanket is to be used. Additionally, most blankets are not adapted to be folded and used as other items, such as bolsters, cushions, pillows, etc. The blanket of the present invention solves many of the known problems with known blankets, and utilizes a novel but highly effective resilient, semi-solid, 100% polyester fleece material that is secured together in two layers for greater versatility and comfort.

Various blankets, coverlets, pillow kits, sleeping bags and toys are known which contain pockets for storing items or pillows may be used to cover pillows, or which may be converted into pillows by the use of strings, zippers, or other fastening means. These known means usually include a separate cover, or the like, which may be converted and/or extended from, or retracted into a body, wherein it is fastened in position by actuation of a cooperating fastening means. These folded or converted items do not make comfortable pillows however, and the cost of manufacturing and assembling the many different parts of such known items is high, particularly when compared to the low cost of manufacturing and assembling, and the ease of use of the novel blanket of the present invention.

One prior art blanket is shown in U.S. Pat. No. 5,179,741 to Book, which discloses a baby blanket having a zipper, which is folded, and the zipper closed to convert the blanket into a pillow. Although this patent discloses a blanket that may be formed into a pillow, it requires that a zipper be used to keep folded sections of the pillow together. The zipper adds to the complexity and cost in manufacturing and cleaning of this blanket.

Other known prior art means are shown in U.S. Pat. No. 1,269,276, which discloses a waterproof pillow covering means having interior pockets therein for storing items when the cover is placed over a filling or a pillow, and tied at its ends by pull string. This patent fails to show a blanket having the advantages set forth for the blanket of the present invention.

Therefore, there still exists a long-felt need in the art for a dependable, easily-used blanket, which is comfortable and made of relatively low-cost and easy-to-manufacture synthetic materials; which is elongated, substantially allergy free and made from 100% polyester fleece for sanitary and other reasons; and which is easily folded, rolled, transported and/or cleaned or washed.

SUMMARY OF THE INVENTION

Accordingly, it is a general object of the present invention to provide an improved blanket. It is a particular object of the present invention to provide an improved blanket with fold lines sewn therein. It is another particular object of the present invention to provide an improved blanket, which is formed from two pieces of material secured together at their edges and by sewn-in fold lines. It is yet a further particular object of the present invention to provide an improved blanket made from two layers of a 100% polyester fleece material, which blanket is easily machine washed and dried in less than half the time required for normal wash and dry cycles. And, it is still a further particular object of the present invention to provide an improved blanket, having fold lines sewn therein to aid in easily forming the blanket into a number of useful articles.

The blanket of the present invention ushers in the era of a versatile adjustable blanket that has long been an acute need for families and individuals who must travel away from home for varying periods of time. Such persons are diverse demographically, but they all have the same need for a superior, functional, more comfortable, aesthetically-pleasing, affordable, luxury blanket, which is easily adjusted, packed and transported, even when "traveling light". The blanket of the present invention meets the needs of such diverse persons. The blanket of the present invention costs less to own and maintain than any blanket currently found in the marketplace. The elongated, 100% polyester fleece fabric that is secured together in two layers of material to form the blanket is effectively allergy-free.

In one embodiment of the present invention the blanket is comprised of a plurality of layers of 100% polyester fleece that are firmly secured together around an outer edge and have fold lines formed therein to allow the blanket to be folded into a number of configurations to form a bolster, a pillow, a cushion, a lap robe, an elongated seat cushion, a child's mattress, or the like, for indoor or outdoor use.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved, adjustable blanket 10, comprised of a plurality of pieces of material. The blanket 10 is preferably formed as a rectangle from at least two pieces of material that may be cut to size, and secured together around the entire outside edges, or outer peripheries 14 thereof, as by an overlock stitching, in a known manner.

Figure 1:
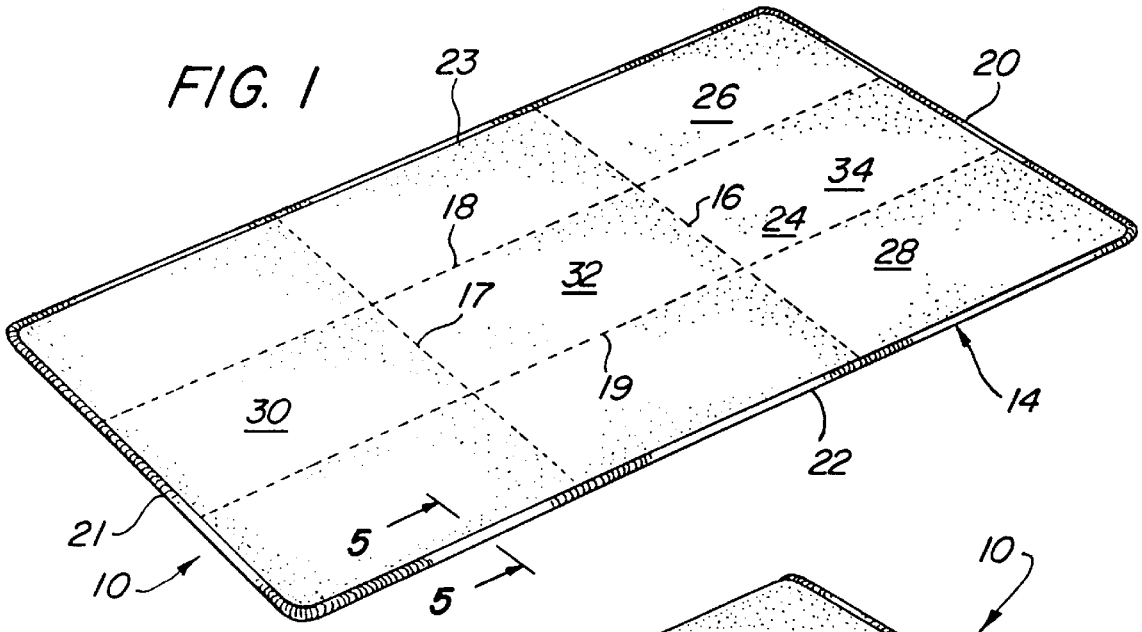
FIG. 1 is a top perspective view of an improved blanket of the present invention, in a flat, unfolded position.

The preferred material 12 to make the double-layer blanket 10 is an 18 ounce, per linear yard weight 100% polyester fleece fabric in approximately 62" lengths. Each piece of material 12 is cut or formed so as to be approximately 42" wide. The weight of the pieces of material may vary, but are generally chosen to help stabilize the size and shape of the blanket 10 and any item formed therewith. As best shown in FIG. 1, after overlock stitching together the outer edges or peripheries 14 of the pieces of material 12, including curved or rounded corners thereof, horizontal or short fold lines 16, 17 and vertical or long fold lines 18, 19 are formed in the blanket 10, as by loosely sewing together the two pieces of material 12 along the lines 16–19. The horizontal or short fold lines 16, 17 are sewn into the blanket 10 approximately ⅓ of the way from each end 20, 21, so as to form three substantially equal horizontal portions approximately 20⅔" wide, if the blanket is 62" long. The long or vertical lines 18, 19 are sewn approximately ⅓ of the way from each side edge 22, 23, or approximately 14" when using a 42" width blanket 10.

The strips of material 12 used to form the double-layer blanket 10, so that the blanket may be easily folded or rolled, as described above, are 18 ounce, 100% polyester fleece material, approximately 62"×42", and held together by the overlock stitched outer edge 14 and the sewn fold lines 16–19 to make a blanket that weighs approximately 3 pounds. The material used allows for significantly faster and easier washing and drying, and for easier adjustment, as by folding or rolling into a bolster, bed pillow, cushion, lap robe, seat cushion, child's mattress, or the like. The blanket is flexible enough to use, and to manipulate it into any of the desired configurations, both indoors and outdoors.

The method of folding the 100% polyester fleece material, double-layer blanket 10 into other configurations will now be described. First, however, it should be pointed out that the size and thickness of each piece of material 12 secured together, as described above, will determine the eventual thickness of any item made therefrom. Because the blanket 10 is specifically designed and dimensioned, the length, width and thickness of the secured together pieces 12 allow the blanket 10 to be easily handled and folded. Furthermore, once formed, the 100% polyester pieces of material 12 in the blanket 10 will be securely held together by the exterior overlock stitched edge 14 and the sewn-in fold lines 16–19. This allows the blanket 10 to be easily manipulated, washed and dried. Additionally, such a blanket 10 retains its shape well and is lower in cost to make and use, since it utilizes material that is more readily available in any desired weight, color, combination or pattern, and has more predictable pricing, delivery time and quality than standard blanket materials.

As shown in FIGS. 1–4, the blanket 10, formed from the secured together pieces of material 12 has three substantially equal long or vertical sections 24 (central), 26 (left) and 28 (right), separated by the loosely sewn-in fold lines 18 and 19. Additionally, the secured together pieces of materials have three substantially equal short or horizontal sections 30 (lower), 32 (middle) and 34 (upper), separated by the loosely sewn-in fold lines 16 and 17.

Figure 2:
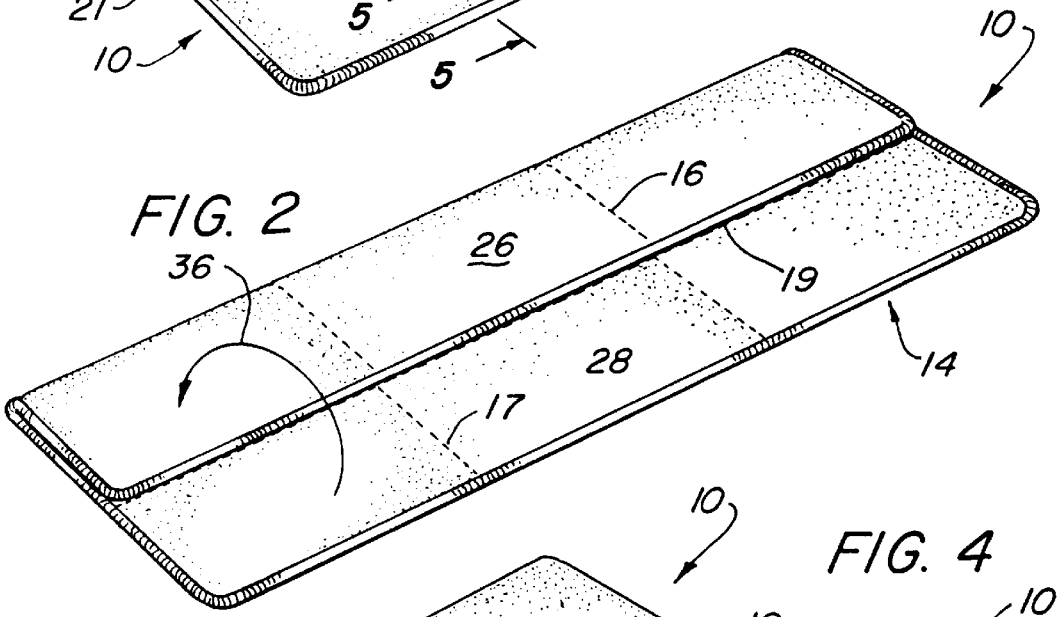
FIG. 2 is a top perspective view of the blanket of FIG. 1 folded along a first long or vertical fold line.
Figure 3:
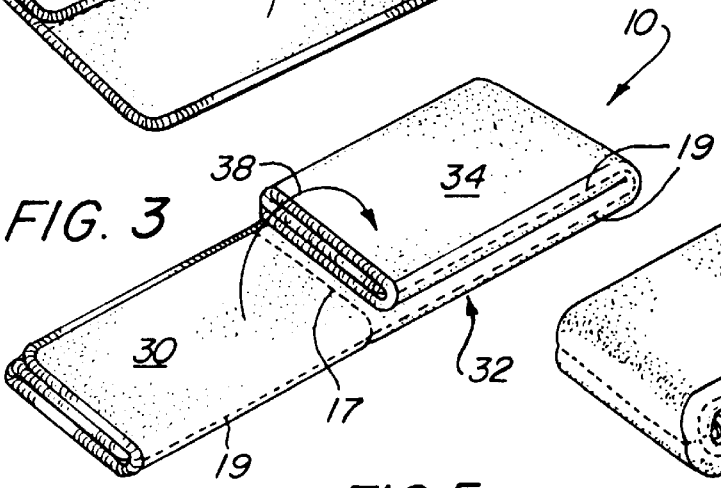
FIG. 3 is a top perspective view of the improved blanket folded along both long or vertical fold lines and one of a pair of horizontal or short fold lines.
Figure 4:
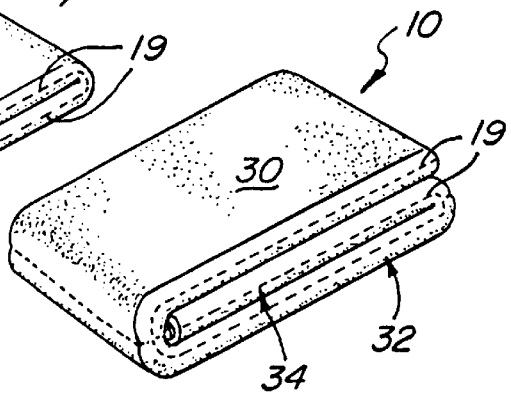
FIG. 4 is a top perspective view of the blanket shown in FIG. 3, folded along the second of the pair of horizontal fold lines, to form a cushion or pillow.
Figure 5:
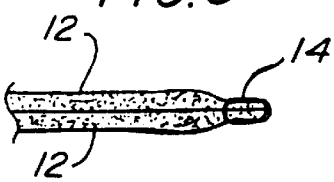
FIG. 5 is a partial cross-sectional view, taken along line 5—5 of FIG. 1, showing the two pieces of material secured together along the outer edge, by overlock stitching.

The blanket 10 may, of course, be easily rolled from either side edge 22, 23, or end 20, 21, to form a bolster or round pillow. Or, as shown in FIGS. 2–4, the first long or vertical left section 26 is folded along fold line 18, in the direction opposite of the arrow 36 (FIG. 2) to cover central section 24. Right section 28 is then folded along fold line 19 in the direction of arrow 36 to cover or overlie sections 24 and 26. The folded blanket, with the section 28 covering sections 24 and 26, may be used as an elongated child's mattress, a lap robe, or an elongated bench seat cushion, for a plurality of persons. Once folded from the sides, the folded blanket 10 may be folded along its length, as shown in FIGS. 3 and 4, or rolled along its length to form a cushion or pillow. That is, the blanket 10 may be folded along fold lines 16 and 17, so that upper, horizontal section 34 is folded over middle horizontal section 32 (FIG. 3), in the opposite direction of arrow 38, and lower horizontal section 30 moved in the direction of arrow 38 to be folded over horizontal sections 32 and 34 (FIG. 4), to form a cushion or pillow, which has many uses, with or without a cover.

The steps described above are easily reversed if the blanket 10 is to be configured differently and/or cleaned or washed.

The entire blanket 10 is engineered and fabricated to control the dimensional stability of any item formed by folding or rolling the same. The thickness of any item formed by folding or rolling the blanket 10 is determined by the initial thickness of the two pieces of material 12, the surrounding overlock stitched edge 14, the tightness of the sewn-in fold lines 16–19, and on how loosely or tightly the blanket is folded or rolled.

As discussed above, the blanket 10 is preferably formed from two pieces of 100% polyester fleece 18 ounce material. The softest faces, such as smooth velour faces are preferably used and oriented so that they face outwardly on the top and bottom surfaces of the blanket. This insures that a user may comfortably rest against a soft face, no matter how the blanket is used or manipulated. Furthermore, the velour faces, when folded or rolled together, hold the blanket 10 to retain shape.

It, therefore, can be seen that the present invention provides a new and improved, relatively low-cost, flexible, double-layer blanket, which is made from two pieces of 100% polyester fleece material secured together around the outer edge, and having fold lines sewn therein. The material used in the blanket allows the blanket to hold its position or shape when folded or rolled, without the need for any additional fastening means, and also allows it to be easily unfolded or unrolled for cleaning or washing.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. An elongated, convertible blanket, consisting of:

two sheets of 100% polyester fleece;

the two sheets of 100% polyester fleece being firmly secured together around outside edges thereof by overlock stitching;

a plurality of fold lines loosely sewn into the two sheets of material between the outside edges, to both aid in securing the two sheets of material together and to provide lines along which the elongated, convertible blanket may be folded into various useful items; and the elongated, convertible blanket having a lower surface and an upper surface, with the lower surface and the upper surface being a smooth velour.

2. The elongated, convertible blanket of claim 1 wherein the elongated, convertible blanket is substantially rectangular with two ends and two sides, with a plurality of horzontal fold lines being formed between the two sides, and a plurality of vertical fold lines being formed between the two ends.

3. The elongated, convertible blanket of claim 2 wherein there are two horizontal fold lines and two vertical fold lines.

4. An elongated, convertible blanket, consisting of:

a pair of rectangular sheets of 100% polyester fleece material fly secured together at first and second ends and opposed side edges;

a pair of horizontal fold lines formed between the first and second ends, said horizontal fold lines connecting the pair of rectangular sheets to each other;

a pair of vertical fold lines formed between the opposed side edges, said vertical fold lines connecting the pair of rectangular sheets to each other; whereby the elongated, convertible blanket may be folded along the horizontal fold lines and the vertical fold lines into various useful items; and the elongated, convertible blanket having a lower surface and an upper surface, with the lower surface and the upper surface being a smooth velour.

5. The elongated, convertible blanket of claim 4 wherein the pair of horizontal fold lines and the pair of vertical fold lines are loosely sewn into the pair of rectangular sheets of 100% polyester fleece material to aid in securing the pair of rectangular sheets of 100% polyester fleece material together.

6. The elongated, convertible blanket of claim 5 wherein the first and second ends and the opposed side edges are held together by overlock stitching.

7. An elongated, convertible blanket consisting of:

two rectangular sheets of 100% polyester fleece material firmly secured together at first and second ends and opposed side edges;

a pair of horizontal fold lines loosely sewn into the two rectangular sheets of 100% polyester fleece material between the first and second ends;

a pair of vertical fold lines loosely sewn into the two rectangular sheets of 100% polyester fleece material between opposed side edges;

the first and second ends and the opposed side edges being held together by overlock stitching; and the elongated, convertible blanket having a lower surface and an upper surface, with the lower surface and the upper surface being a smooth velour.

* * * * *

UNITED STATES PATENT AND TRADEMARK OFFICE

CERTIFICATE OF CORRECTION

PATENT NO. : 6,094,759

DATED : AUGUST 1, 2000

INVENTOR(S) : THOMAS L. THOMPSON

It is certified that error appears in the above-identified patent and that said Letters Patent are hereby corrected as shown below:

COLUMN 5, LINE 16, "fly" should be changed to --firmly--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*